US010702746B2

(12) United States Patent
Park

(10) Patent No.: US 10,702,746 B2
(45) Date of Patent: Jul. 7, 2020

(54) WET SUIT

(71) Applicant: Young Chan Park, Seongnam-si (KR)

(72) Inventor: Young Chan Park, Seongnam-si (KR)

( * ) Notice: Subject to any disclaimer, the term of this patent is extended or adjusted under 35 U.S.C. 154(b) by 0 days.

(21) Appl. No.: 16/211,252

(22) Filed: Dec. 6, 2018

(65) Prior Publication Data

US 2019/0175992 A1 Jun. 13, 2019

(30) Foreign Application Priority Data

Dec. 7, 2017 (KR) ..... 10-2017-0167199
Nov. 12, 2018 (KR) ..... 10-2018-0138056

(51) Int. Cl.

| | |
|---|---|
| ***A63B 35/00*** | (2006.01) |
| ***B63C 11/46*** | (2006.01) |
| ***B63C 11/08*** | (2006.01) |
| ***B63C 9/105*** | (2006.01) |
| ***A63B 35/12*** | (2006.01) |
| ***B63C 11/04*** | (2006.01) |
| ***A41D 1/00*** | (2018.01) |
| ***A41D 1/08*** | (2018.01) |
| ***A41D 3/00*** | (2006.01) |
| ***A41D 7/00*** | (2006.01) |
| ***A41D 13/012*** | (2006.01) |

(52) U.S. Cl.

CPC ..... *A63B 35/00* (2013.01); *A41D 1/002* (2013.01); *A41D 1/08* (2013.01); *A41D 3/00* (2013.01); *A41D 7/003* (2013.01); *A41D 13/0125* (2013.01); *A63B 35/12* (2013.01); *B63C 9/1055* (2013.01); *B63C 11/04* (2013.01); *B63C 11/08* (2013.01); *B63C 11/46* (2013.01); *A41D 2600/10* (2013.01)

(58) Field of Classification Search

CPC ..... A63B 35/00; A41D 1/002
See application file for complete search history.

(56) References Cited

U.S. PATENT DOCUMENTS 3,635,188 A * 1/1972 Rutkowski ..... A63B 35/12 440/6
4,867,720 A * 9/1989 Harrington ..... A63B 31/12 441/60
5,346,419 A * 9/1994 Kaiser ..... B63C 11/08 114/315
6,823,813 B2 * 11/2004 Mazin ..... B63C 11/46 114/315

(Continued)

FOREIGN PATENT DOCUMENTS

KR 10-1995-0000511 A 1/1995
KR 10-1022974 B1 3/2011

(Continued)

*Primary Examiner* — S. Joseph Morano
*Assistant Examiner* — Jovon E Hayes
(74) *Attorney, Agent, or Firm* — Revolution IP, PLLC

(57) ABSTRACT

Disclosed is a wet suit, including: an upper jacket 100 for, putted on an upper body of a user, injecting or discharging air into an interior by the user's operation or a predetermined operation; a pair of lower pants 200 putted on a lower body of the user; and a propulsive generation portion 300 for, detachably putted on a waist of the user, generating a self-propulsive force according to the user's operation or a predetermined operation to generates a propulsive force for pushing water to a rear direction of the user.

9 Claims, 8 Drawing Sheets

(56) References Cited

U.S. PATENT DOCUMENTS

| | | | | |
|---|---|---|---|---|
| 8,567,336 | B1 * | 10/2013 | Mazin | A63B 31/12 114/315 |
| 8,793,892 | B2 * | 8/2014 | McLoughlin | F26B 9/003 211/182 |
| 9,878,211 | B1 * | 1/2018 | Knowles | A63B 35/00 |
| 10,398,940 | B2 * | 9/2019 | Grosse Austing | A63B 35/12 |
| 2004/0094083 | A1 * | 5/2004 | Mazin | A63B 35/12 114/315 |
| 2019/0175992 | A1 * | 6/2019 | Park | A41D 1/002 |

FOREIGN PATENT DOCUMENTS

| | | | |
|---|---|---|---|
| KR | 10-1182957 | B1 | 9/2012 |
| KR | 10-2014-0120790 | A | 10/2014 |

* cited by examiner (a)

(b)

WET SUIT

CROSS-REFERENCE TO RELATED APPLICATIONS

This application claims priority under 35 U.S.C. § 119 to KR Patent Application No. 10-2018-0138056 filed Nov. 12, 2018. Priority is also claimed to KR Patent Application No. 10-2017-0167199 filed Dec. 7, 2017. These applications are hereby incorporated by reference in their entirety.

BACKGROUND

The present invention relates to a wet suit, and more particularly, to a wet suit which is capable of floating in water or automatically moving to a destination using self-propulsive force without using any rescue equipment.

Today, the population to enjoy marine leisure sports around surf clubs and scuba diving clubs is increasing rapidly. This tendency is reflected in the current trend of finding a room in the present life, unlike the past that devoted to the stable life of the future.

In many countries, which have the sea, rakes or rivers, marine leisure sports have been established only in the concept of leisure. Recently, the cruise law and marina act passed the national assembly plenary session, and the government is expected to nurture the marine leisure industry and expect the world marine industry to revitalize.

Water sports represents all kinds of water sports acting in rivers and seas, and includes traditional swimming, canoeing, kayaking, yachting and rubber boating, as well as windsurfing, kite boarding combined with surfing and paragliding, Kite surfing, water skiing, wakeboarding, jet skiing, fly fishing, and banana boats, etc.

These kinds of water sports are diversified every year, and people who enjoy these water sports are not only increasing in number, but also the places of water sports are diversified to rivers, seas and the sea, the importance of water leisure safety is also increasing, but it is still dependent on life jackets and wet suits.

For example, Korean Patent Publication No. 1995-0000511 (Jan. 3, 1995) discloses the buoyancy regulator for a wet suit to maintain neutral buoyancy at all times according to the depth of the submerged member. The feature of this publication is that a pressure regulating portion 60 is formed with an inlet 61 and a buoyancy adjusting graduation portion 62, 62', 62" and a weight display part 31 is formed on the support part 30, as the rubber film sheet 20 is sandwiched between the pressure forming portion 10 and the supporting portion, and the pressure regulating portion 60 is engaged with the spring 40 and the emergency button 50 so as to be in contact with the rubber film sheet 20.

In addition, Korean Patent Publication No. 10-1022974 (Mar. 9, 2011) discloses the flight suit for airline pilots with a life jacket and a manufacturing method thereof, which could not penetrate by liquids such as water into the interior, and has the characteristic of discharging out the water vapor from the body, excellent in fire resistance, comfort, warmth, waterproof performance, and are very easy to wear or peel.

In addition, Korean Patent Publication No. 10-1182957 (Sep. 7, 2012) discloses the life jacket combined of expansion tube and buoyant material, which absorb impact force or pushing force applied to the user's bust part, especially the heart, by a buoyant material of the life jacket, provide the warmth in cold weather, prevent flooding by primarily acting buoyancy when the user is dropped in the water, and folate the heart part of the recipient on the water surface to prevent drowning due to the high buoyancy of the air inflatable type air tube inherent in the life jacket.

Korean Patent Laid-Open Publication No. 10-2014-0120790 (Oct. 14, 2014) discloses the under wet suit, in which a warm pad is installed inside in which a cable for transmitting electric power is installed inside the under wet suit, so that it is possible to provide convenience in performing underwater activities by constituting along waist circumference. And the button portion configured with velcro can be selectively removed and attached by forming the attachment portion outside the wet suit, and each of the constitutions is configured by a heat generating device constituted by a structure capable of being combined and separated.

However, the main purpose of the conventional water sports wetsuit or life vest is to allow the user to float in the water for a predetermined time using buoyancy until the user is rescued from being dropped in the water. At this time, if the user needs to move before reaching Golden Time for survival (about 1 hour), the user must move to the desired destination by swimming or diving while wearing the wet suit. However, for those who are not good at water sports, or for the elderly, it will not be long enough to float in the water or to swim or dive over a distance, even if you wear a life jacket or wet suit.

The present invention has been made in order to solve the problems of the conventional art described above, it is an object of the present invention to provide a wet suit, which can continuously generate buoyancy by manually or automatically injecting additional air into an upper jacket and/or a pair of lower pants selectively, when the user wears the upper jacket and/or the pair of lower pants with constant buoyancy and an accident occurs in the water while enjoying water sports.

Another object of the present invention is to provide a wet suit which can be floated in water in a standing position for a certain time by generating a self-propulsive force in the event of an accident occurring in water during a user enjoying water sports.

Another object of the present invention is to provide a water suit which can move to the destination in a upright posture while raising the chest part on the water surface by generating a self-propulsive force when an accident occurs in the water during an enjoyment of water sports.

It is a further object of the present invention to provide a wet suit that can be implemented and provided with various types of wireless power generation devices therein.

A water suit comprises an upper jacket 100 worn on an upper body of a user, injecting or discharging air into an interior by the user's operation or a predetermined operation; a pair of lower pants 200 worn on a lower body of the user; and a propulsive generation portion 300 detachably worn on a waist of the user, generating a self-propulsive force according to the user's operation or a predetermined operation to generates a propulsive force for pushing water to a rear direction of the user.

According to the wet suit according to the present invention, the wet suit may continuously generate buoyancy by manually or automatically injecting additional air into an upper jacket and/or a pair of lower pants selectively, when the user wears the upper jacket and/or the pair of lower pants with constant buoyancy and an accident occurs in the water while enjoying water sports. Therefore, when enjoying water sports, it is not necessary to wear life jackets or wet suit that make movement unnatural, and the user may maximize the enjoyment of water sports by wearing only water suits easily according to the present invention.

In addition, the wet suit may be floated in water in a standing position for a certain time by generating a self-propulsive force in the event of an accident occurring in water during a user enjoying water sports. In case of being in the water, the heart part can be floated on the water surface for a certain period of time, thereby prolonging the user rescue time.

In addition, the water suit may be moved to the destination in a upright posture while raising the chest part on the water surface by generating a self-propulsive force when an accident occurs in the water during an enjoyment of water sports. Therefore, there is obtained an effect that it is easy to move to the desired destination within the golden time for survival, even if the user is a young person or an elderly person who is not good at swimming.

In addition, since various types of wireless power generation devices can be implemented, not only the water suit may generate the self-propulsive force for a long time, but also the reliability of the product can be increased.

DETAILED DESCRIPTION

Hereinafter, the construction and operation of a wet suit according to a preferred embodiment of the present invention will be described with reference to the accompanying drawings.

Figure 1:
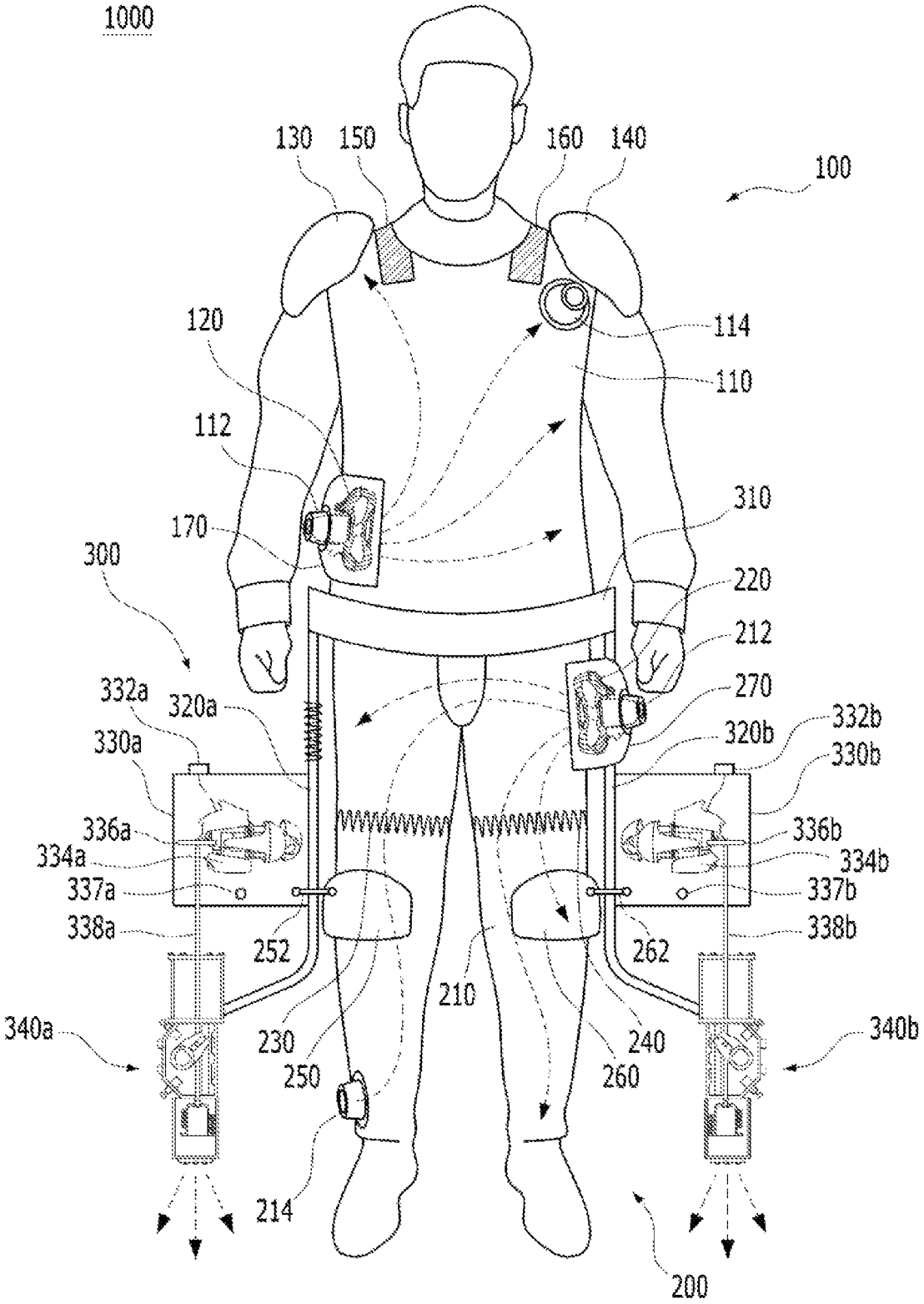
FIG. 1 is a view showing a state in which a user wears a wet suit according to a preferred embodiment of the present invention.

FIG. 1 is a perspective view of a wet suit according to a preferred embodiment of the present invention.

Referring to FIG. 1, the water suit 1000 according to the preferred embodiment of the present invention includes an upper jacket 100 worn on the upper body of a user, injecting or discharging air into an interior by a user's operation or a predetermined operation (for example, according to a detection value from a pair of water level sensors 337*a* and 337*b*), while using a first wireless rechargeable battery 121; and a propulsive generation portion 300 detachably worn on the waist of the user, and generating a self-propulsive force according to the user's operation or a predetermined operation (for example, according to a detection value from a pair of water level sensors 337*a* and 337*b*) to generates the propulsive force for pushing water to the rear direction of the user.

Here, the water suit 1000 according to the preferred embodiment of the present invention further includes a pair of lower pants 200 worn on the lower body of the user, and injecting or discharging air into the interior by using the second wireless rechargeable battery 221 by the user's operation or the predetermined operation (for example, according to a detection value from a pair of water level sensors 337*a* and 337*b*). As described above, when the pair of lower pants 200 is further provided, the buoyancy of the water suit will be highly improved.

Here, the upper jacket 100, as shown in FIG. 1, includes an upper jacket body 110 including an interior in which the injected air is stored, a first air inlet 112 for injecting air in the lower end portion, and a first air outlet 114 for discharging air stored in the interior in an upper end therein, if necessary; and a first blower 120 fixed to the front end of the first air inlet 112 formed in the interior of a first waterproof pocket 170 formed at the lower end of the upper jacket body 110, and injecting air into the interior of the upper jacket body 110 by generating wind in the water using a first wireless rechargeable battery 121 according to the user's operation or the predetermined operation according to a detection value from a pair of water level sensors 337*a* and 337*b*.

If necessary, the upper jacket 100, also further includes a pair of lift wings 130 and 140 fixed to the upper end of the upper jacket body 110, and generating lifting force in the shoulder part when the user moves in the water with the upright posture; and a pair of bubble generators 150 and 160 fixed to the upper end of the upper jacket body 110 and generating bubbles to generate buoyancy rotated by the propulsive force pushing water to a rearward direction.

Here, the upper jacket body 110 may be selected from a wet, dry, or semi-dry type material, and the material can also be selected from the following materials: Ultra soft raedial (USRD), which combines the water repellency of the skin paper and the durability of the jersey, New megoflex having an outer material with Ultra span jersey with a stretch ratio of 500% in four directions compared to general jersey, and inner material used BGX fabric that keeps the elasticity of the Ultra span maximized while increasing warmth through small friction with skin; Tuftex used to protect the shoulder part from BCD as a material with higher abrasion resistance than Lycra; Lycra, which excellent color and gloss, have little discoloration, customizes design using various colors, Air nap ideally knitted Polyester with excellent water-blocking properties and warmth is reinforced and nylon yarn with an air layer reinforced with soft touch; Nylon which is thinner than webs and strong against friction, so it has superior tensile strength compared to other fibers, as the most commonly used and longest used fabric for wetsuits; and Glitron have antimicrobial effect for suppressing the occurrence of bacteria and adiabatic effect by specially coating fine powder of titanium and aluminum with highly flexible neoprene.

Figure 2:
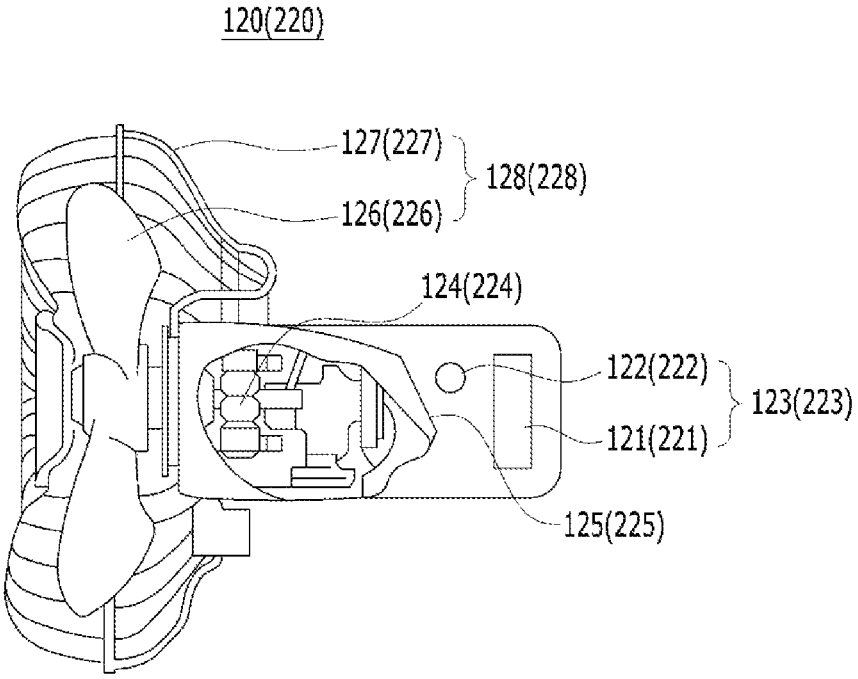
FIG. 2 is a view for explaining the structure of a first or a second blower of a wet suit according to a preferred embodiment of the present invention.

Here, the first blower 120, as shown in FIG. 2, includes a first handle portion 123 having an interior in which a first wireless rechargeable battery 121 is installed and an outer surface on which a power switch 122 is mounted; a first body portion 125 fixed to the upper end of the first handle portion 123 and having an electric motor 124 for the first blower 120 which is electrically connected to the first wireless rechargeable battery 121; and a first blower blade portion 128 having a blower blade 126 fixed to a shaft so as to be rotatable in conjunction with the electric motor 124 for the first blower 120, and a first guard net 127 mounted outside of the blower blade 126.

In the preferred embodiment of the present invention, the first blower 120 is installed to be inserted into the first waterproof pocket 170 formed at the inner lower end of the upper jacket body 110, and the user can operate the first power switch 122 for the first blower 120 by putting his or her hand on the need or remotely from the outside.

The pair of lift wings 130 and 140 are installed to minimize friction caused by water when the user moves quickly from the water to up-and-down posture. For the fast water flow to the surface, the outer part is formed as an arccurved beam to allow the user to float upward by generating the upper part of the water surface with a relatively lower pressure than the lower part of the water surface.

Also, the pair of lower pants 200, as shown in FIG. 1, includes a lower pants body 210 including an interior in which the injected air is stored, a second air inlet 212 for injecting air into the upper end, and a second air outlet 214 formed at the lower end for discharging the air being stored therein; and a second blower 220 fixed to a front end of the second air inlet 212 formed inside of a second waterproof pocket 270 formed at the lower end of the lower pants body 210, and generating wind in the water to inject air into the lower pants body 210 by using a second wireless rechargeable battery 221.

And, the pair of lower pants 200 further includes a pair of joint springs 230 and 240 installed at knee portions of the lower pants body 210 to allow flexible rotational motion of the user's knee in the water while wearing the pair of lower pants 200; a pair of knee protectors 250 and 260 installed at the knee portion of the lower pants body 210 to fix the first and second driving force generation units 330: 330*a*,330*b* provided in the propulsive generation portion 300, and a pair of fixing rods 252 and 262 fixed to the pair of knee protector 250 and 260.

Here, the lower pants body 210 is made of the same material as the material of the upper jacket body 110, the second blower 220 is installed to be fixed inside the second waterproof pocket 270 formed at the inner lower end of the lower pants body 210, and the user can manipulate the second power switch 222 by putting his or her hand or remotely control from the outside in need.

The second blower 220 includes a second handle portion 223 having a second wireless rechargeable battery 221 inserted therein and a second power switch 222 mounted on the outer surface thereof, and a second body portion 225 having a second electric motor 224 fixed to an upper end of the second handle portion 223 and electrically connected to the second wireless rechargeable battery 221.

The second blower 220 may additionally include a blower blade portion 228 having a second blower blade 226 fixed to the shaft to be rotatable in conjunction with the second electric motor 224 of the second blower body portion 225, and a second wing net 227 mounted on the outside of a second blower blade 226.

Also, the propulsive generation portion 300, as shown in FIG. 1, includes a belt body 310 fixed to the waist of the user; first and second supporters 320*a* and 320*b* fixed to both side surfaces of the belt body 310 and extended to a predetermined length in the ground surface direction; first and second driving force generation units 330: 330*a* and 330*b* fixed to the first and second supporters 320*a* and 320*b*, and repeatedly performing forward rotation and reverse rotational movement in one direction in the water depending on the user's operation or the detection value of a pair of water level sensors 337*a* and 337*b*; and first and second driving motors 340: 340*a*, 340*b* connected to the rear ends of the first and second driving force generation units 330: 330*a*, 330*b*, and generating the propulsive force to repeatedly push the water in the rearward direction of the user using the rotational movement (forward rotation or reverse rotation) of the first and second driving force generation units 330: 330*a*, 330*b*.

Also, each of the first or second driving force generation units 330: 330*a*, 330*b* includes a body 331: 331*a*, 331*b* having power switches 332*a*, 332*b*; electric motors 333: 333*a*, 333*b* provided inside the bodies 331: 331*a*, 331*b* to generate driving force; a wireless recharging unit 334: 334*a*, 334*b* installed inside the bodies 331: 331*a*, 331*b*, and supplying electric power to the electric motors 333: 333*a*, 333*b*; a control unit 335: 335*a*, 335*b* for controlling the charging/discharging operation of the wireless recharging unit 334: 334*a*, 334*b* or the operation of the electric motor 333: 333*a*, 333*b*; a tail portion 336: 336*a*, 336*b* for rotating in the left and right direction or the up and down direction by controlling the control unit 335: 335*a*, 335*b*; a pair of water level sensors 337*a* and 337*b* for detecting the level of the surrounding water and forwarding a detection value to the control units 335: 335*a* and 335*b*; and a connecting rod 338: 338*a*,338*b* respectively connected to the tail portions 336: 336*a*, 336*b*, and forwarding the rotational driving force according to the rotational movement of the tail portion 336: 336*a*, 336*b* to the first and second driving motors 340: 340*a*, 340*b*.

Here, the connecting rod 338 serves as a connecting rod for connecting the piston 345 and the crankshaft.

In the preferred embodiment of the present invention, the pair of water level sensors 337*a*, 337*b* measure the level of water into the water and forward the detection value to the control unit 335: 335*a*,335*b* to determine whether it may be simply splashing water or falling into the water using the principle that as the amount of water is increased, the resistance decreases and the flowing current increases, on the contrary, when the amount of water is decreased, the resistance decreases and the flowing current also will be decreased.

Further, the electric motor 333: 333*a*, 333*b* are used in order for the first and second driving force generation units 330: 330*a*, 330*b* to move a certain distance in the water, the wireless recharging unit 334: 334*a*, 334*b* for supplying electric power to the electric motors 333: 333*a*, 333*b* is a light, thin and large capacity lithium polymer battery are preferably used.

Figure 3A:
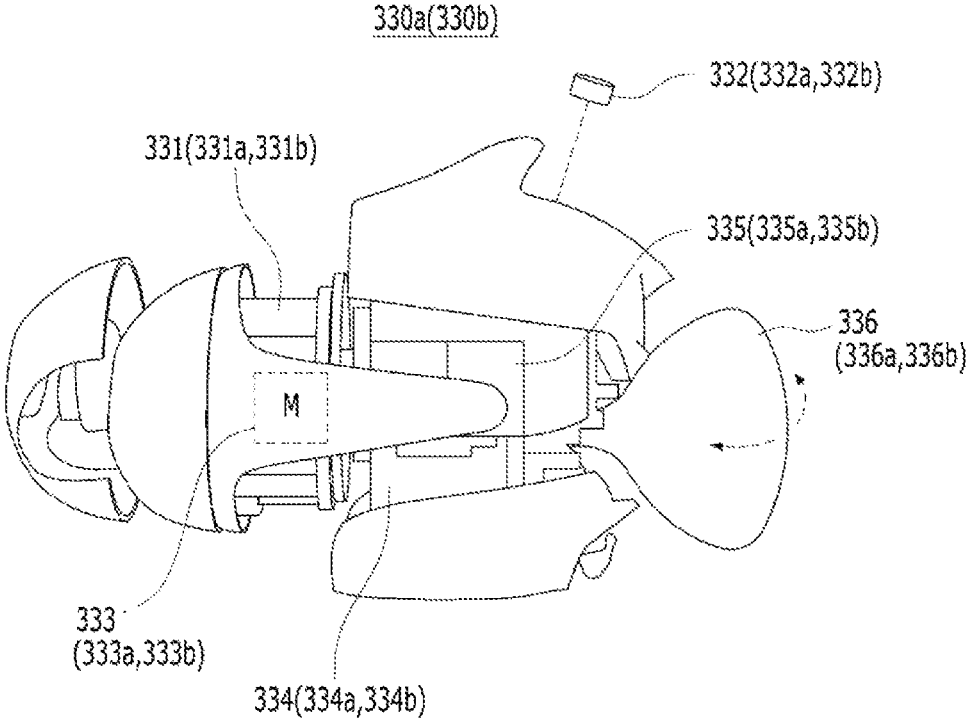
FIGS. 3A to 3D are views for explaining a structure of a wireless driving force generation unit provided in a water suit according to a preferred embodiment of the present invention.
Figure 3B:
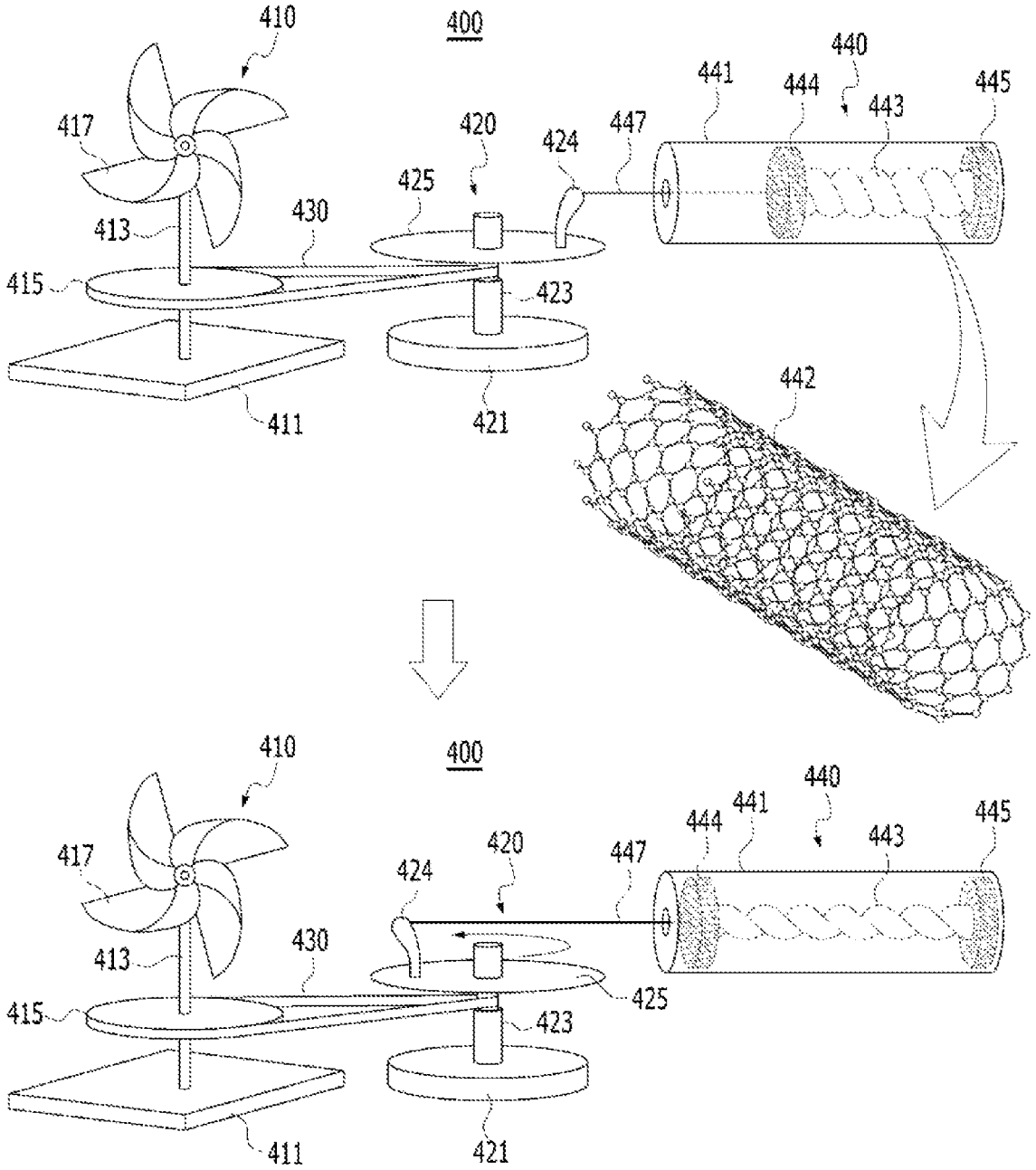
Figure 3C:
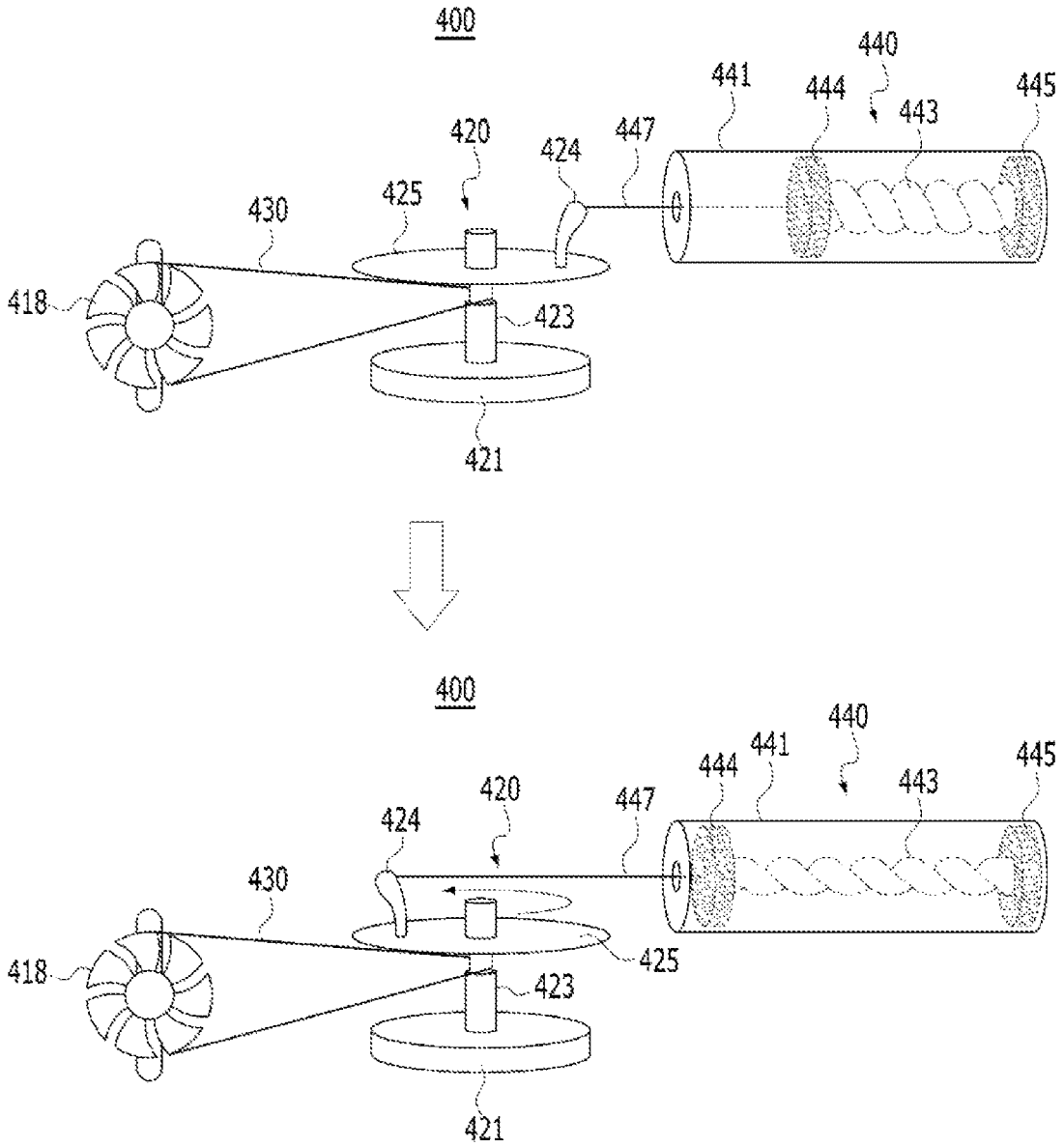

Here, instead of the wireless recharging unit 334, first through third wireless recharging units 400 to 500 using a twisted-ron as shown in FIG. 3*b* through FIG. 3*c* are selectively applied, so that the electricity can be supplied to the electric motor 333 without using an independent electricity generating device.

That is, as shown in FIGS. 3B to 3C, the first wireless recharging unit 400 includes a rotational portion 410 having a first rotational disk 415 rotatably mounted on a first shaft 413 installed in a vertical direction on a first base plate 411, and a water vane 417 or an electric motor 418 which is rotatably installed at the upper end of the shaft 413; a second rotational portion 420 having a second rotational disk 425 which is rotatably installed on the upper end of the second shaft rod 423 installed in a vertical direction on an upper portion of the second base plate 421, and includes a projection rod 424 protruded in a direction perpendicular to the upper surface thereof; a first belt 430 installed between the first rotational disk 415 of the rotational portion 410 and a second axial rod 423 of the second rotational portion 420; a first self-generation portion 440 including a first cylindrical case 441 filled with the electrolyte material to be sealed, a first twisted-ron 443 formed to have a carbon nanotube structure 442 and installed in a predetermined length in the longitudinal direction within the first cylindrical case 441, first electrodes 444 and 445 provided at both side ends of the first twisted-ron 443, and a first cable 447 having one end fixed to the upper end of the first twisted-ron 443 and the other end fixed to the projection rod 424 of the second rotary disk 425.

Here, the third wireless recharging unit shown in FIG. 3C does not use the water vane 417 as compared with the second wireless recharging unit shown in FIG. 3B, and there is only a difference in using a motor 418.

Figure 3D:
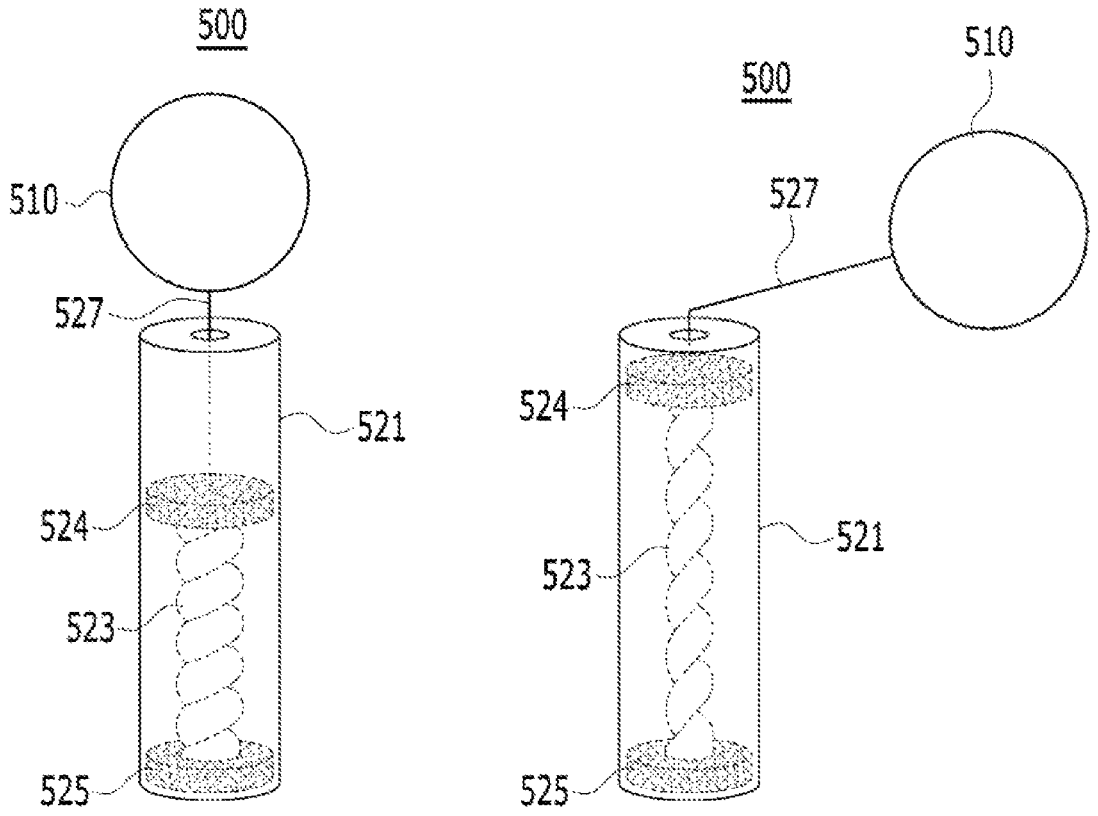

Also, as shown in FIG. 3D, the third wireless recharging unit 500 includes a helium balloon 510 which drifts in the free direction according to the flow of the wave current; and a second self-generation portion 520 including a second cylindrical case 521 filled with the electrolyte material to be sealed, a second twisted-ron 523 formed to have a carbon nanotube structure 522 and installed in a predetermined length in the longitudinal direction within the second cylindrical case 521, second electrodes 524 and 525 provided at both side ends of the second twisted-ron 523, and a second cable 527 having one end fixed to the upper end of the second twisted-ron 523 and the other end fixed to the helium balloon 510.

In the various wireless recharging units configured as shown in FIGS. 3*b* to 3*d*, the first and second cylindrical cases 441 and 521 are preferably cylindrical glass bottles, the electrolyte materials are substances that dissolve in a polar solvent such as water to conduct electricity. The electrolyte dissolved in the solvent is divided into cations and anions and spreads evenly throughout the solution. The solution in this state is electrically neutral.

In addition, the first and second twisted-ron 443 and 523 are yarns that produce power by themselves by using the principle that the energy changes as the material contracts or moves, since thin carbon nanotubes of 1/10,000th of the thickness of hair are excessively twisted in one direction to form a coil shape like a rubber band. Such a twisted-ron can easily relax the shrink within about 30% ranges due to a spring-like structure having a cylindrical tube shape in which six hexagons of carbon are connected to form a tubular shape. First, the carbon nanotubes are twisted to form a high-strength, lightweight yarn, and further twisted to form a coil-shaped yarn to give high elasticity. If the first and second twisted-ron 443 and 523 yarns are pulled in the electrolyte, the kinetics is increased as increasing the density, while reducing the internal surface area, resulting in capacitance is decreased. The electric potential energy is changed by the amount of change of the capacitance, thereby producing the electric energy.

When the first electrodes 444 and 445 and the second electrodes 524 and 525 are installed in the first and second cylindrical cases 341 and 521 and the voltage is applied between the two electrodes, the ions in the solution act as a carrier of electric charge to flow the current, since the positive ions gather toward the cathode electrode and the anion moves toward the anode electrode that receives the electrons.

Accordingly, if the water vane 417 connected to the twisted-ron or the rotational disk coupled to the electric motor 418 is repeatedly performed shrinkage and relaxation operations 30 times per second in the electrolyte using the power of wind or electricity, then it can produce 250 w power per kilogram.

Figure 4:
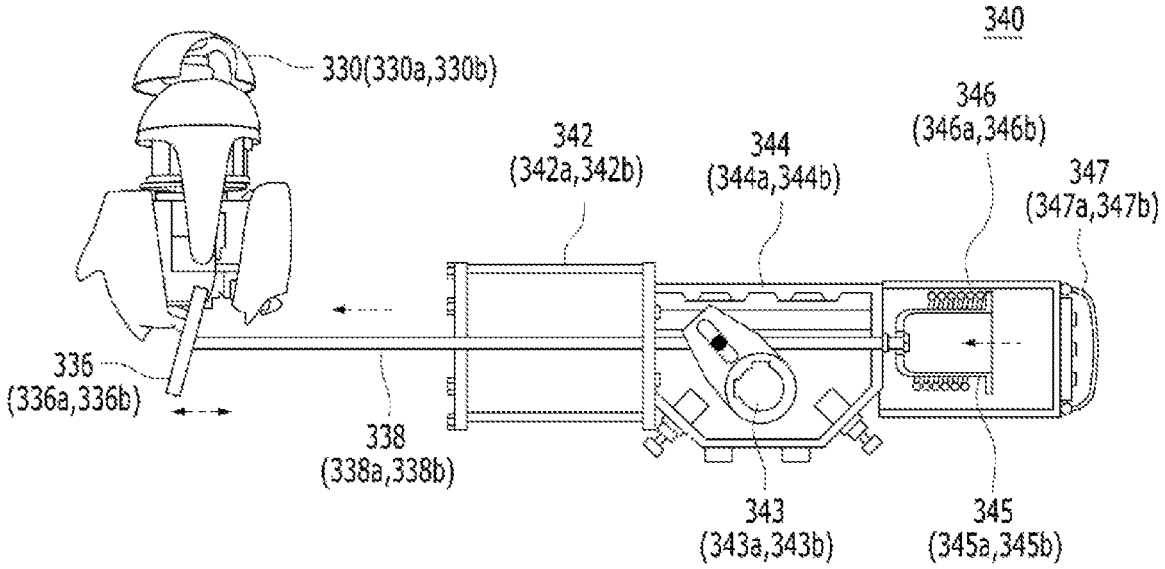
FIG. 4 is a view for explaining the operation in the case where the drive motor is a scotch yoke motor provided in the water suit according to the preferred embodiment of the present invention.
Figure 4:
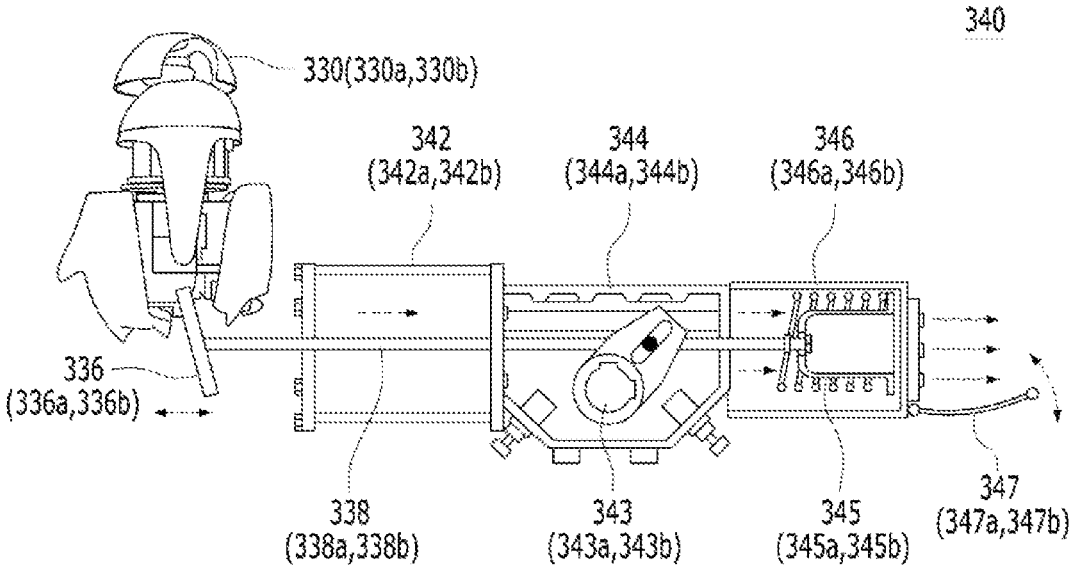

In the preferred embodiment of the present invention, each of the first and second driving motors 340: 340*a*, 340*b* is preferably a scotch yoke motor as shown in FIGS. 4*a* and 4*b*.

Meanwhile, the first and second driving motor 340: 340*a*, 340*b* includes an yoke 343: 343*a*, 343*b*, where the first or second tail portion 336: 336*a*, 336*b* is inserted into the housing 344: 344*a*, 344*b* and for converting 90° forward rotation and reverse rotation into reciprocating linear motion; and a piston 345: 345*a*, 345*b* of which one side is connected to the connecting rod 338: 338*a*, 338*b* connected to the tail portion 336: 336*a*, 336*b* of the first or second driving force generation unit 330: 330*a*, 330*b* 338*b*, and the other side is installed inside the cylinder 342: 342*a*,342*b* to be connected to the yoke 343: 343*a*, 343*b* of the housing 344: 344*a*, 344*b*, and outwardly pushing the water from the inside of the cylinder by the 90° forward rotation and the reverse rotation of the yoke 343: 343*a*, 343*b*.

At this time, the tail portions 336: 336*a*, 336*b* using the batteries 334: 334*a* and 334*b* are connected to the yokes 343: 343*a*, 343*b* by the connecting rods 338: 338*a* and 338*b* in a straight line. Here, the yoke 343: 343*a*,343*b* converts 90° positive rotation and reverse rotation into the reciprocating linear movement by forming a magnetic circuit in the motor.

Here, as shown in FIG. 4B, the cylinder actuators 347: 347*a*, 347*b* are installed at the lower ends of the cylinders 342: 342*a*,342*b* to selectively open or close the cylinder actuators 347: 347*a*, 347*b*. That is, as the piston 345: 345*a*, 345*b* is pushed in the rearward direction of the cylinder 342: 342*a*, 342*b* to discharge the water inside the cylinder 342: 342*a*, 342*b*, and the cylinder actuators 347: 347*a*, 347*b* can be opened by water pressure, while if the first or second piston 345: 345*a*,345*b* installed in the cylinder 342: 342*a*, 342*b* is pulled forward, as shown in FIG. 4A, The cylinder actuators 347: 347*a*, 347*b* is closed by water pressure. Accordingly, the water can be prevented from flowing into the cylinders 342: 342*a*, 342*b* by the pulled pistons 345: 345*a*,345*b*.

Here, one end of the cylinder actuator 347: 347*a*, 347*b* is fixed to a bottom surface of the first or second piston 345: 345*a*, 345*b* and the other end is detachably connected to the other side of the piston 345: 345*a*, 345*b* by means of the plate spring 346: 346*a*, 346*b* constituting the cylinder actuator 347: 347*a*, 347*b*. When the piston 345: 345*a*, 345*b* is pushed in the rearward direction, the plate spring 346: 346*a*, 346*b* constituting the cylinder actuator 347: 347*a*, 347*b* spreads in the rearward direction by the water pressure, thereby opening the cylinder actuators 347: 347*a*, 347*b*.

Hereinafter, the operation of the wet suit according to the preferred embodiment of the present invention will be described with reference to the accompanying drawings.

FIG. 1, the user wears the upper jacket 100 and the propulsive generation portion 300, and/or the pair of lower pants 200 as shown in FIG. 1, and can enjoy the water leisure sports the user desired. At this time, because there is a constant buoyancy due to the constant air entering the upper jacket 100 and the pair of lower pants 200. Thus, even if the user can enjoy any water leisure sports, the user may not feel the inconvenience.

On the other hand, if the user who enjoys water leisure sports falls into the water due to the unexpected situation, the first and second power switch 122 and/or 222 of the first blower 120 and/or the second blower 220 and the power switches 332: 332*a*, 332*b* of the driving force generation unit 330: 330*a*, 330*b* are manually powered on within a predetermined time (for example, 3 seconds), or the control unit 335: 335*a*,335*b* controls to be automatically powered on the power switch 122 and/or 222 of the first blower 120 and/or the second blower 220 and the power switches 332: 332*a*, 332*b* of the driving force generation unit 330: 330*a*, 330*b* within a predetermined time (for example, 3 seconds) according to the detection value of the pair of water level sensors 337*a* and 337*b* by using wireless control technology.

Accordingly, the first blower 120 generates air in the water to inject air into the upper jacket body 110, and/or the second blower 220 can also generate air in the water to inject air into the lower pants body 210. Thus, this allows the user to float to the surface of the water even if the user is fallen into the water due to the additional buoyancy generated in the upper jacket body 110 and/or the lower pants body 210, respectively. At this time, the first blower 120 and/or the second blower 220 are floating in water so that they do not touch the water.

Also, when the first and second power switches 332: 332*a*, 332*b* of the first and second driving force generation units 330: 330*a*, 330*b* are powered on, the control units 335: 335*a* and 335*b* of the first and second driving force generation units 330: 330*a* and 330*b* controls to be driven respective electric motors 333: 333*a* and 333*b* by forwardly and backwardly rotating the tail portion 336: 336*a*, 336*b* in a predetermined direction. As shown in FIGS. 4A and 4B, the piston 345: 345*a*, 345*b* is reciprocated by the forward rotation and the reverse rotation of the first and/or second driving motors 340: 340*a*, 340*b* to perform the linear motion. This allows the first and second pistons 345: 345*a*, 345*b* to repeatedly push from the cylinder to the rear direction, thereby generating the propulsive force, where the cylinder performs the reciprocating linear motion by the 90° positive rotation and the reverse rotation of the yokes 343: 343*a*, 343*b*.

Figure 5:
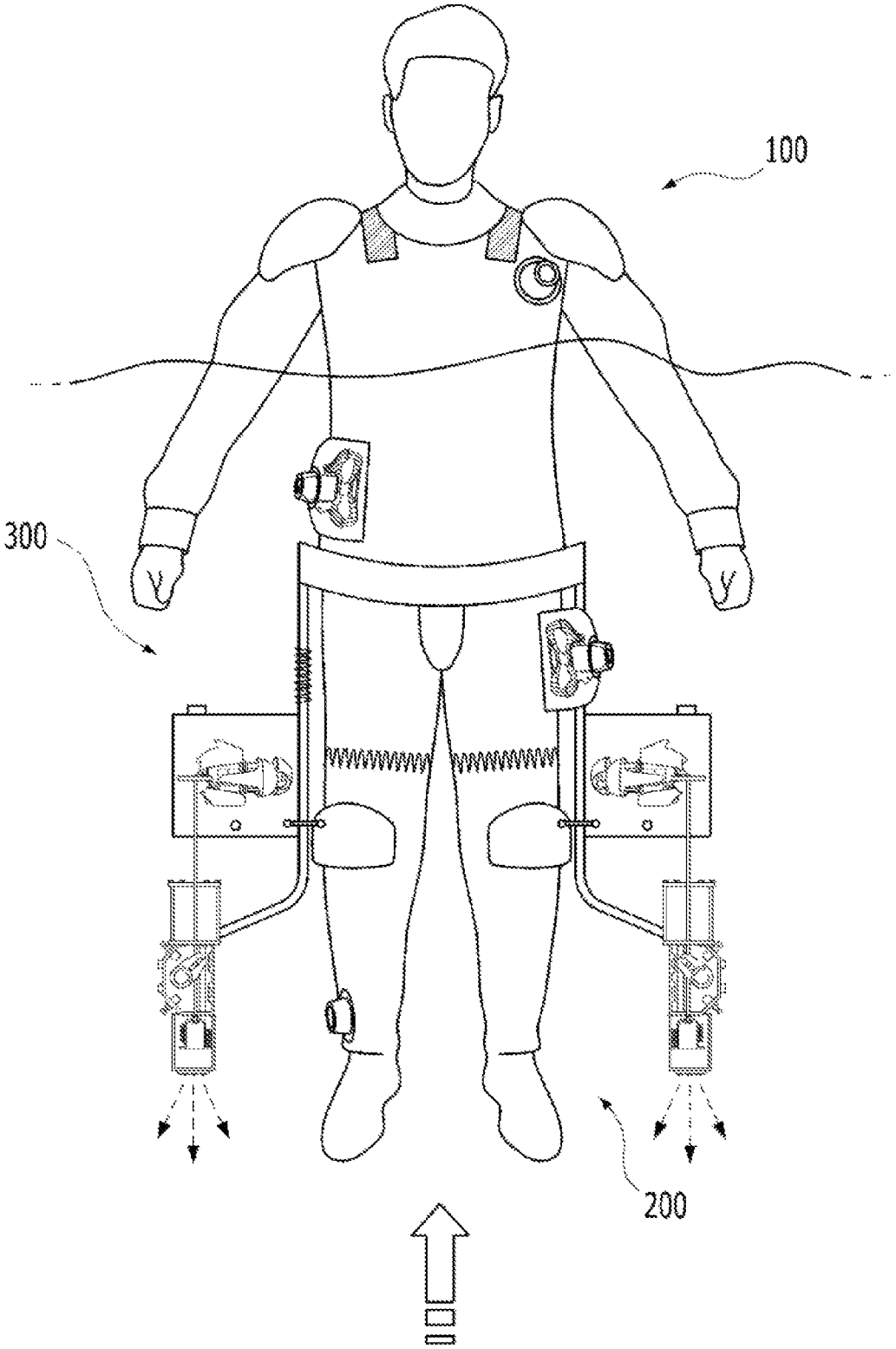
FIG. 5 is a view for explaining an erecting operation without swimming in water while wearing a wet suit according to a preferred embodiment of the present invention.

Accordingly, when the user takes the upright posture in a state of falling into water, as shown in FIG. 5, The user may float for a period of time (not less than one hour) without sinking into the water due to the buoyancy generated in each of the upper jacket body 110 and/or the lower pants body 210 and the propulsive forces of the first and second pistons 345: 345*a* and 345*b*, respectively. Such the operation of the upright posture may be preferable in the posture taken when the rescue is possible within a relatively short time within the visible range, when the user is in the water while enjoying water leisure sports.

Figure 6:
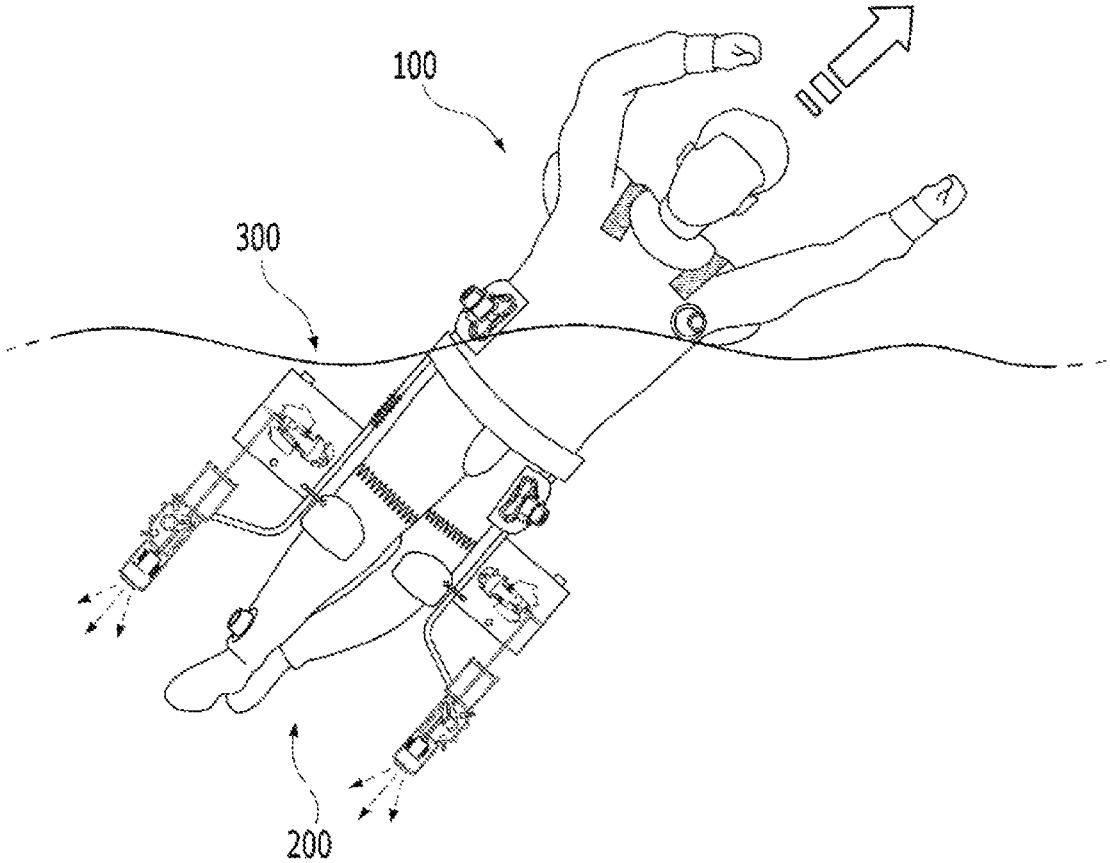
FIG. 6 is a view for explaining an operation of moving a user to a destination in a upright posture while raising the chest part in the water sufficiently in a state of wearing a wet suit according to a preferred embodiment of the present invention.

However, in situations where the rescuer is not within visible distance, it is desirable for the user who is in the water to move to any location, structure or land where the rescue is possible. When the user turns his or her body to the sleeping position toward the destination as shown in FIG. 6, the user can be moved to the destination even if the user does not swim due to the buoyancy generated in the upper jacket body 110 and/or the lower pants body 210 and the propulsive force generated by the reciprocating movement of the first and second pistons 345: 345*a*, 345*b*.

In the preferred embodiment of the present invention described above, the wireless recharging unit 334: 334*a* and 334*b* is used to provide electricity to electric motors 333: 333*a*, 333*b* for the operation of the first and second driving force generation units 330: 330*a* and 330*b* in the water, but the electricity used in the electric motor 333 can be supplied by itself without using the separate electricity generating device by using the first to third wireless recharging units 400 to 500 selectively applying the twisted-ron as shown in FIGS. 3B to 3C.

While the present invention has been particularly shown and described with reference to exemplary embodiments thereof, it is clearly understood that the same is by way of illustration and example only and is not to be construed as limiting the scope of the invention as defined by the appended claims. It will be understood by those skilled in the art that various changes in form and details may be made therein without departing from the spirit and scope of the invention.

What is claimed is:

1. A water suit comprising:

an upper jacket worn on an upper body of a user, and configured to inject or discharge air;

a pair of lower pants worn on a lower body of the user; and a propulsive generation portion detachably worn on a waist of the user, and generating a self-propulsive force to generates a propulsive force for pushing water to a rear direction of the user, wherein the upper jacket comprises:

an upper jacket body having an interior in which the injected air is stored;

a first waterproof pocket formed at a lower end of the upper jacket body;

a first air inlet formed in an interior of the first waterproof pocket for injecting air;

a first air outlet formed at an upper end of the upper jacket body for discharging air stored in the interior of the upper jacket body; and a first blower fixed to a front end of the first air inlet and injecting air into the interior of the upper jacket body by generating wind in the water.

2. The water suit according to claim 1, wherein the upper jacket further comprises:

a pair of lift wings fixed to the upper end of the upper jacket body and generating lifting force in a shoulder part when the user moves in the water with the upright posture; and a pair of bubble generators fixed to the upper end of the upper jacket body and generating bubbles to generate buoyancy rotated by the propulsive force pushing water to a rearward direction.

3. The water suit according to claim 1, wherein the pair of lower pants is configured to inject or discharge air.

4. The water suit according to claim 3, wherein the pair of lower pants comprises:

a lower pants body having an interior in which the injected air is stored;

a second waterproof pocket formed at an upper end of the lower pants body;

a second air inlet formed in an interior of the second waterproof pocket for injecting air;

a second air outlet formed at an lower end of the lower pants body for discharging air stored in the interior of the lower pants body; and a second blower fixed to a front end of the second air inlet, and generating wind in the water to inject air into the interior of the lower pants body by using a second wireless rechargeable battery.

5. The water suit according to claim 4, wherein the pair of lower pants further comprises:

a pair of joint springs installed at knee portions of the lower pants body to allow flexible rotational motion of the user's knee in the water;

a pair of knee protectors installed at the knee portion of the lower pants body to fix first and second driving force generation units provided in the propulsive generation portion; and a pair of fixing rods fixed to the pair of knee protectors.

6. The water suit according to claim 1, wherein the propulsive generation portion comprises:

a belt body fixed to the waist of the user;

first and second supporters fixed to both side surfaces of the belt body and extended to a predetermined length in the ground surface direction;

first and second driving force generation units fixed to the first and second supporters, and repeatedly performing forward rotation and reverse rotational movement in one direction in the water; and first and second driving motors connected to rear ends of the first and second driving force generation units, and generating the propulsive force to repeatedly push the water in the rearward direction of the user by using the rotational movement of the first and second driving force generation units.

7. The water suit according to claim 6, wherein the first and second driving force generation unit comprise:

a body having power switches;

electric motors installed inside the bodies to generate a driving force;

a first wireless recharging unit installed inside the bodies, and supplying electric power to the electric motors;

a control unit controlling the charging/discharging operation of the first wireless recharging unit or the operation of the electric motor;

a tail portion for rotating in the left and right direction or the up and down direction by the control unit;

a pair of water level sensors detecting the level of the surrounding water and forwarding a detection value to the control units; and a connecting rod respectively connected to the tail portion, and forwarding the rotational driving force according to the rotational movement of the tail portion to the first and second driving motors.

8. The water suit according to claim 7, wherein the first wireless recharging unit comprises:

a rotational portion having a first rotational disk rotatably mounted on a first shaft which is installed in a vertical direction on a first base plate, and a water vane or an electric motor which is rotatably installed at the upper end of the shaft;

a second rotational portion having a second rotational disk, rotatably installed on the upper end of the second shaft rod which is installed in a vertical direction on an upper portion of the second base plate, the second rotational disk including a projection rod protruded in a direction perpendicular to the upper surface thereof;

a first belt installed between the first rotational disk of the rotational portion and a second axial rod of the second rotational portion; and a first self-generation portion including a first cylindrical case filled with the electrolyte material to be sealed, a first twisted-ron formed to have a carbon nanotube structure and installed in a predetermined length in the longitudinal direction within the first cylindrical case, first electrodes provided at both side ends of the first twisted-ron, and a first cable having one end fixed to the upper end of the first twisted-ron and the other end fixed to the projection rod of the second rotary disk.

9. The water suit according to claim 7, wherein the first wireless recharging unit is replaced with a third wireless recharging unit, and the third wireless recharging unit comprises:

a helium balloon; and a second self-generation portion including a second cylindrical case filled with the electrolyte material to be sealed, a second twisted-ron formed to have a carbon nanotube structure and installed in a predetermined length in the longitudinal direction within the second cylindrical case, second electrodes provided at both side ends of the second twisted-ron, and a second cable having one end fixed to the upper end of the second twisted-ron and the other end fixed to the helium balloon.

* * * * *